US009241381B2

(12) United States Patent
Feng et al.

(10) Patent No.: US 9,241,381 B2
(45) Date of Patent: Jan. 19, 2016

(54) LED DRIVING CIRCUIT, CONTROL CIRCUIT AND ASSOCIATED CURRENT SENSING CIRCUIT

(71) Applicant: Chengdu Monolithic Power Systems Co., Ltd., Chengdu (CN)

(72) Inventors: Lin Feng, Chengdu (CN); Yuedong Chen, Chengdu (CN)

(73) Assignee: Chengdu Monolithic Power Systems Co., Ltd., Chengdu (CN)

( * ) Notice: Subject to any disclaimer, the term of this patent is extended or adjusted under 35 U.S.C. 154(b) by 0 days.

(21) Appl. No.: 14/585,645

(22) Filed: Dec. 30, 2014

(65) Prior Publication Data

US 2015/0189710 A1 Jul. 2, 2015

(30) Foreign Application Priority Data

Dec. 30, 2013 (CN) ..... 2013 1 0745479

(51) Int. Cl.
*H05B 33/08* (2006.01)

(52) U.S. Cl.
CPC ..... *H05B 33/0818* (2013.01)

(58) Field of Classification Search
CPC ..... H05B 33/08; H05B 33/0815; H05B 33/0818; H05B 33/0848; H05B 37/02
USPC ..... 315/201, 205, 206, 219, 279, 291, 297, 315/307, 308
See application file for complete search history.

(56) References Cited

U.S. PATENT DOCUMENTS

| | | | | |
|---|---|---|---|---|
| 2006/0077697 | A1* | 4/2006 | Yang | 363/21.13 |
| 2012/0169245 | A1* | 7/2012 | Chen | 315/223 |
| 2013/0057173 | A1* | 3/2013 | Yao et al. | 315/206 |
| 2014/0111108 | A1* | 4/2014 | Qu et al. | 315/206 |

* cited by examiner

*Primary Examiner* — Thai Pham
(74) *Attorney, Agent, or Firm* — Perkins Coie LLP

(57) ABSTRACT

A LED driving circuit, a control circuit and associated current sensing circuit. The control circuit has a sensing circuit, an estimation circuit, an amplifying circuit, a comparing circuit, a zero-cross detection circuit and a logic circuit. The sensing circuit is configured to sense a switching current flowing through at least one switch of a switching circuit to provide a first sensing signal. The estimation circuit is configured to process the first sensing signal to provide a feedback signal, wherein the feedback signal is indicative of a average current signal flowing through a LED. An average current flowing through the LED is regulated by sensing a switching current flowing through at least one switch.

16 Claims, 6 Drawing Sheets

LED DRIVING CIRCUIT, CONTROL CIRCUIT AND ASSOCIATED CURRENT SENSING CIRCUIT

CROSS-REFERENCE TO RELATED APPLICATION(S)

This application claims the benefit of CN application No. 201310745479.7 filed on Dec. 30, 2013 and incorporated herein by reference.

TECHNICAL FIELD

The present invention generally relates to electronic circuits, and more particularly but not exclusively relates to a LED driving circuit, a control circuit and associated current sensing circuit.

BACKGROUND

Generally, in LED lighting applications, AC-DC power conversion sources are often applied as power supplies for driving the LED. Typically, two types of AC-DC power conversion topologies, either isolated or non-isolated can be used.

FIG. 1 illustrates an isolated topology application 50A for LED driving. As shown in FIG. 1, an AC voltage signal $V_{AC}$ is converted to a DC voltage signal $V_{DC}$ by a rectification circuit 51. Then the DC voltage signal $V_{DC}$ is further converted to a suitable DC voltage signal for driving LEDs 53 by a flyback voltage converter 52 which comprises a transformer. The transformer of the flyback voltage converter 52 isolates a primary circuit and a secondary circuit in this isolated topology application. In one embodiment, the LEDs 53 may comprise a single LED. In one embodiment, the LEDs 53 may comprise a LED string. In one embodiment, the LEDs 53 may comprise a plurality of LED strings. In a LED driving application, the most important point is that a constant average current $I_{LED}$ flowing through the LEDs 53 are needed to be achieved by a constant current control method. Generally, the average current $I_{LED}$ in the secondary circuit is sensed as a feedback signal provided to a control circuit for regulating the constancy of the average current $I_{LED}$. The control circuit is configured to receive the feedback signal and coupled to a switch 521 in the primary circuit for switching the switch 521 on and off. However, since the primary circuit and the secondary circuit are isolated in this application, the average current $I_{LED}$ in the secondary circuit can not be coupled to the control circuit directly. An expensive optocoupler or other suitable devices should be applied resulting in a high cost.

FIG. 2 illustrates a non-isolated topology application 50B. As shown in FIG. 2, comparing to the isolated topology application 50A, the transformer is omitted in the non-isolated topology application 50B. Therefore, LEDs 53 are coupled to the rectification circuit 51 for receiving a DC voltage signal $V_{DC}$ directly. In this situation, sensing an average current $I_{LED}$ flowing through the LEDs 53 is infeasible due to the high DC voltage signal $V_{DC}$ across the LEDs 53.

Accordingly, a cost-effective and feasible LED driving circuit, a control circuit and associated current sensing circuit for LED lighting applications are desired.

SUMMARY

In one embodiment, the present invention discloses a control circuit for a LED driving circuit. The LED driving circuit comprises a switching circuit comprising at least one switch and an inductive element, wherein the switching circuit is configured to receive a DC voltage signal for driving a LED, and to receive a control signal configured to control the at least one switch to switch on and off so as to regulate an average current flowing through the LED. The control circuit comprising a sensing circuit coupled between the at least one switch and a logic ground, wherein the sensing circuit is configured to sense a switching current flowing through the at least one switch, and to provide a first sensing signal, and wherein the first sensing signal is indicative of the switching current; an estimation circuit having an input terminal and an output terminal, wherein the input terminal of the estimation circuit is coupled to the sensing circuit for receiving the first sensing signal; and wherein the estimation circuit is configured to process the first sensing signal, and to provide a feedback signal at the output terminal, wherein the feedback signal is indicative of the average current signal flowing through the LED; an amplifying circuit having a first input terminal, a second input terminal and an output terminal, wherein the first input terminal of the amplifying circuit is coupled to the output terminal of the estimation circuit for receiving the feedback signal; and wherein the second input terminal of the amplifying circuit is configured to receive a reference signal, wherein the reference signal is indicative of a desired average current of the LED; and wherein the amplifying circuit is configured to amplify the difference of the feedback signal and the reference signal, and to provide an error signal at the output terminal; a comparing circuit having a first input terminal, a second input terminal and an output terminal, wherein the first input terminal of the comparing circuit is coupled to the output terminal of the amplifying circuit for receiving the error signal; and wherein the second input terminal of the comparing circuit is configured to receive the first sensing signal; and wherein the comparing circuit is configured to compare the error signal with the first sensing signal, and to provide a comparing signal at the output terminal; and wherein when the first sensing signal is larger than the error signal, the comparing signal is configured to turn the at least one switch off; and a zero-cross detection circuit having an input terminal and an output terminal, wherein the input terminal of the zero-cross detection circuit is coupled to the switching circuit, and configured to receive a current signal flowing through the inductive element so as to generate a second sensing signal, wherein the second sensing signal is indicative of the current signal flowing through the inductive element; and wherein the zero-cross detection circuit is configured to compare the second sensing signal with a zero-cross threshold, and to provide a zero-cross signal at the output terminal; and wherein when the second sensing signal decreases to the zero-cross threshold, the zero-cross signal is configured to turn the at least one switch on.

In one embodiment, the present invention discloses a LED driving circuit. The LED driving circuit comprise: a rectification circuit configured to receive and rectify an AC voltage signal so as to provide a DC voltage signal; a switching circuit comprising at least one switch and an inductive element, wherein the switching circuit is configured to receive the DC voltage signal for driving a LED, and to regulate an average current flowing through the LED by controlling the at least one switch switching on and off; a sensing circuit coupled between the at least switch and a logic ground, wherein the sensing circuit is configured to sense a switching current flowing through the at least one switch, and to provide a first sensing signal, wherein the first sensing signal is indicative of the switching current; an estimation circuit having an input terminal and an output terminal, wherein the input terminal of the estimation circuit is coupled to the sensing circuit for receiving the first sensing signal; and wherein the estimation circuit is configured to process the first sensing signal, and to provide a feedback signal at the output terminal, wherein the feedback signal is indicative of the average current signal flowing through the LED; an amplifying circuit having a first input terminal, a second input terminal and an output terminal, wherein the first input terminal of the amplifying circuit is coupled to the output terminal of the estimation circuit for receiving the feedback signal; and wherein the second input terminal of the amplifying circuit is configured to receive a reference signal, wherein the reference signal is indicative of a desired average current of the LED; and wherein the amplifying circuit is configured to amplify the difference of the feedback signal and the reference signal, and to provide an error signal at the output terminal; a comparing circuit having a first input terminal, a second input terminal and an output terminal, wherein the first input terminal of the comparing circuit is coupled to the output terminal of the amplifying circuit for receiving the error signal; and wherein the second input terminal of the comparing circuit is configured to receive the first current sensing signal; and wherein the comparing circuit is configured to compare the error signal with the first sensing signal, and to provide a comparing signal at the output terminal; and wherein when the first sensing signal is larger than the error signal, the comparing signal is configured to turn the at least one switch off; and a zero-cross detection circuit having an input terminal and an output terminal, wherein the input terminal of the zero-cross detection circuit is coupled to the switching circuit, and configured to sense a current signal flowing through the inductive element so as to generate a second sensing signal, wherein the second sensing signal is indicative of the current signal flowing through the inductive element; and wherein the zero-cross detection circuit is configured to compare the second sensing signal with a zero-cross threshold, and to provide a zero-cross signal at the output terminal; and wherein when the second sensing signal decreases to the zero-cross threshold, the zero-cross signal is configured to turn the at least one switch on.

In one embodiment, the present invention discloses an average current sensing circuit for a LED driving circuit comprising at least one switch and an inductive element, wherein an average current signal flowing through a LED is regulated by switching the at least one switch on and off. The average current sensing circuit comprising: a first sensing circuit coupled between the at least one switch and a logic ground, wherein the first sensing circuit is configured to sense a switching current flowing through the at least one switch, and to provide a first sensing signal; and an estimation circuit coupled to the first sensing circuit for receiving the first sensing signal, wherein the estimation circuit is configured to convert the first sensing signal, and to provide a feedback signal at an output terminal of the estimation circuit, wherein the feedback signal is indicative of the average current flowing through the LED.

BRIEF DESCRIPTION OF THE DRAWINGS

Non-limiting and non-exhaustive embodiments are described with reference to the following drawings. The drawings are only for illustration purpose. Usually, the drawings only show part of the system or circuit of the embodiment, and the same reference labels in different drawings have the same, similar or corresponding features or functions.

DETAILED DESCRIPTION

The embodiments of the present invention are described in next. While the invention will be described in conjunction with various embodiments, it will be understood that they are not intended to limit the invention to these embodiments. On contrary, the invention is intended to cover alternatives, modifications and equivalents, which may be included within the spirit and scope of the invention as defined by the appended claims. Furthermore, in the following detailed description of the embodiments of the present invention, numerous specific details are set forth in order to provide a thorough understanding of the embodiments of the present invention. However, it will be obvious to one of ordinary skill in the art that without these specific details the embodiments of the present invention may be practiced. In other instance, well-know circuits, materials, and methods have not been described in detail so as not to unnecessarily obscure aspect of the embodiments of the present invention.

Figure 1:
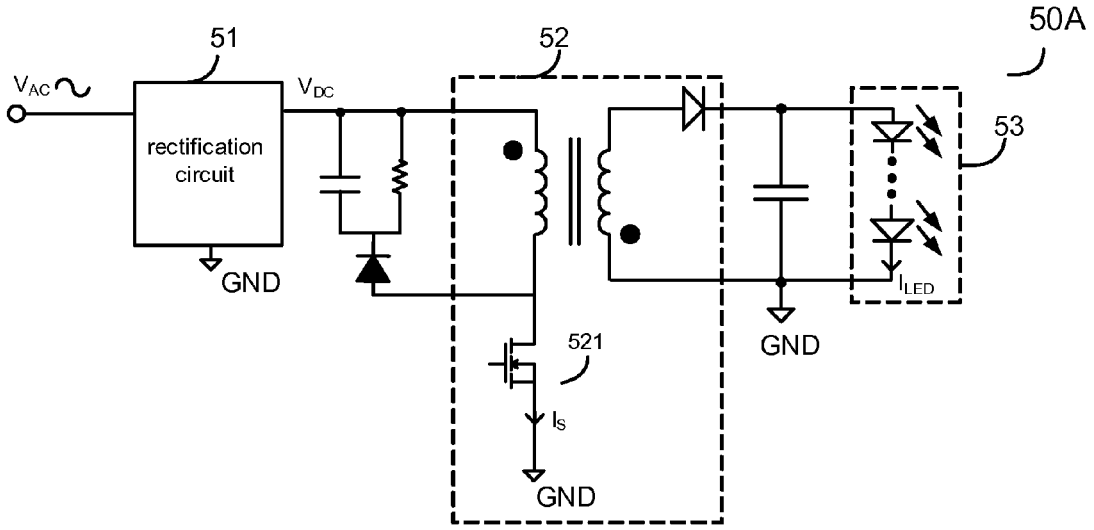
FIG. 1 (Prior Art)
FIG. 1 schematically illustrates an isolated topology application for LED driving.
Figure 2:
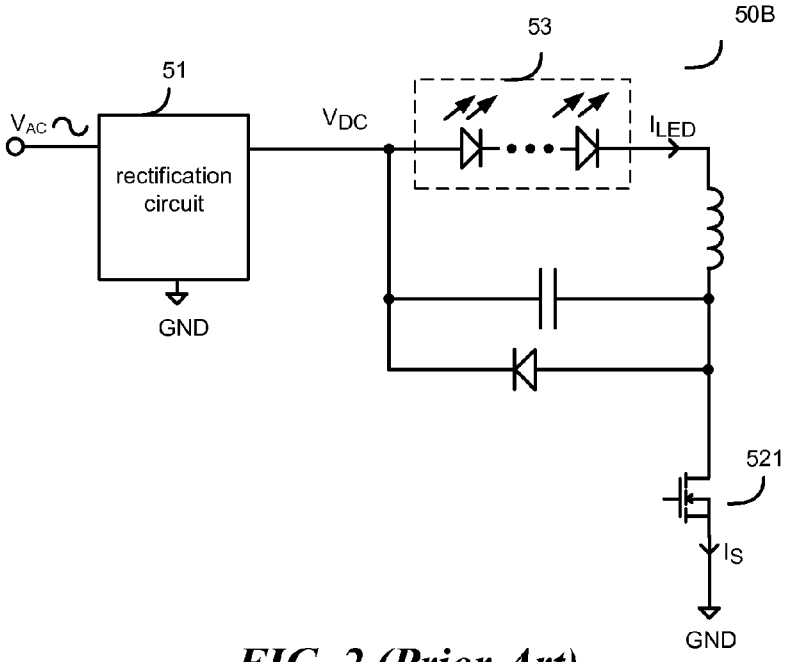
FIG. 2 (Prior Art)
FIG. 2 schematically illustrates a non-isolated topology application for LED driving.
Figure 3:
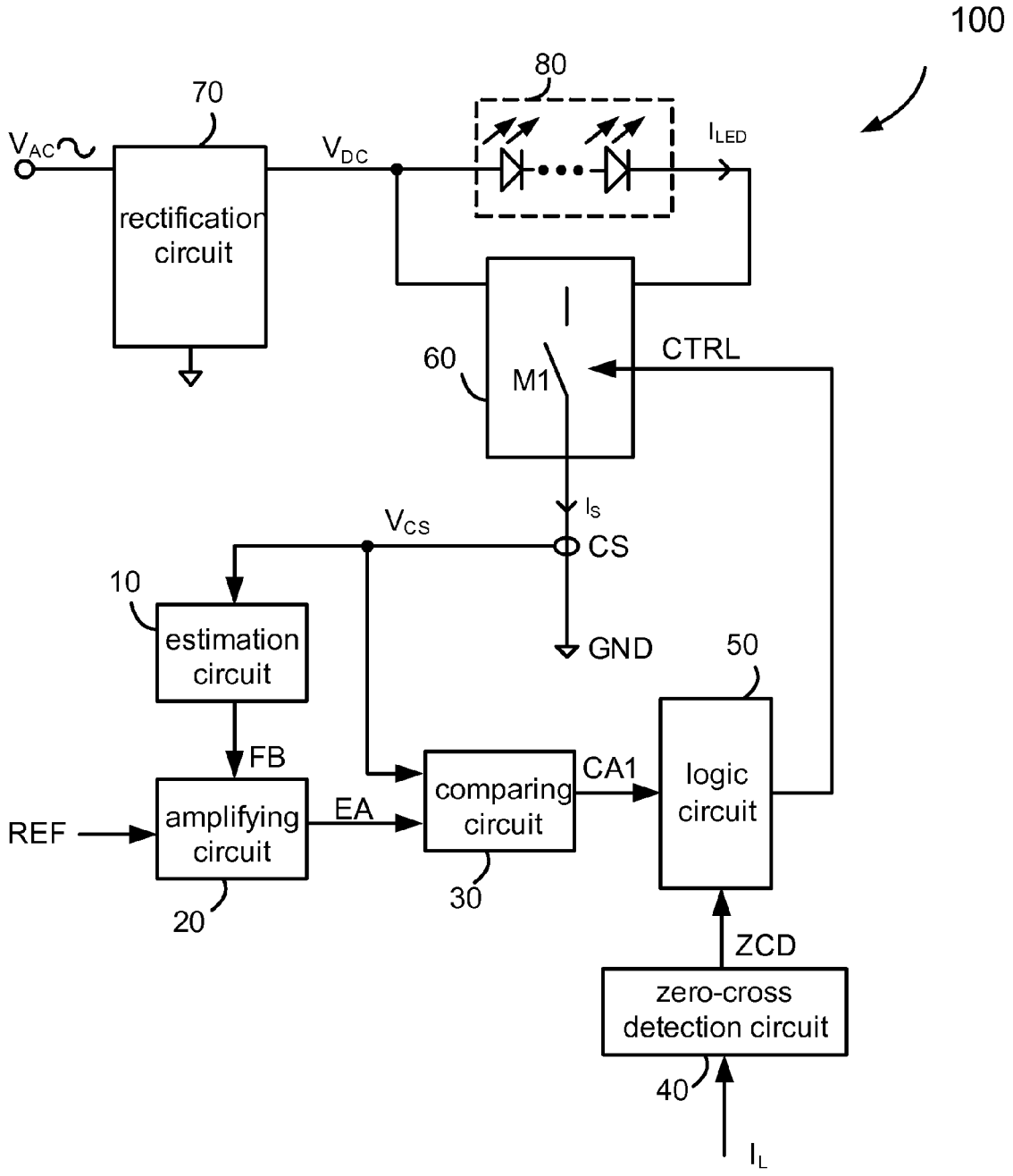
FIG. 3 illustrates a LED driving circuit according to an embodiment of the present invention.

FIG. 3 illustrates a LED driving circuit 100 according to an embodiment of the present invention. As shown in FIG. 3, the LED driving circuit 100 may comprise a rectification circuit 70, a switching circuit 60 and a control circuit. In one embodiment, the LED driving circuit 100 may operate in a critical conduction mode.

The rectification circuit 70 may have an input terminal and an output terminal. The input terminal of the rectification circuit 70 is configured to receive an AC voltage signal $V_{AC}$. The rectification circuit 70 may be configured to rectify the AC voltage signal $V_{AC}$ and to provide a DC voltage signal $V_{DC}$ at the output terminal.

The switching circuit 60 may comprise at least one switch having a first state and a second state. As shown in FIG. 3, the plurality of LED strings 80 may be connected to the DC voltage signal $V_{DC}$ directly. The average current signal $I_{LED}$ flowing through the plurality of LED strings 80 may be regulated by controlling the at least one switch to switch between the first state and the second state. In one embodiment, the first state is an on state and the second state is an off state. In another embodiment, the first state is an off state and the second state is an on state.

The switching circuit 60 may further comprise an inductive element configured to convert energy. When the at least one switch is turned on, the inductive element may store energy, and when the at least one switch is turned off, the inductive element may release energy stored. In one embodiment, the at least one switch may comprise a switch M1. In such application, the switching circuit 60 may be a non-isolated topology switching circuit, e.g. a buck topology. The inductive element of the switching circuit 60 may comprise an inductor. When the switch M1 is turned on, the inductor stores energy, and the inductor current signal $I_L$ flowing through the inductor may be increased linearly to a peak value. When the switch M1 is turned off, the inductor releases energy stored, and the inductor current signal $I_L$ flowing through the inductor may be decreased linearly from the peak value. In one embodiment, the switching circuit 60 may comprise other suitable topology switching circuits. The switch M1 may comprise any semiconductor switching devices, such as a Metal Oxide Semiconductor Field Effect Transistor (MOSFET), an Insulated Gate Bipolar Transistor (IGBT) and the like.

The control circuit may comprise a sensing circuit 90 and an estimation circuit 10. In one embodiment, the sensing circuit 90 may be configured to sense a switching current flowing through the at least one switch and to provide a first current sensing signal which is indicative of the switching current flowing through the at least one switch. The estimation circuit 10 may be configured to receive the first current sensing signal and to calculate an average current flowing through the plurality of LED strings 80 by the current sensing signal. The control circuit can regulate the average current flowing through the plurality of LED strings 80 constantly by sensing the switching current flowing through the at least one switch.

In one embodiment, the sensing circuit 90 is configured to sense a switching current signal $I_S$ flowing through the switch M1 and to provide a first current sensing signal $V_{CS}$ which is indicative of the switching current signal $I_S$. The estimation circuit 10 may be configured to calculate an average current $I_{LED}$ of the plurality of LED strings 80 by the first current sensing signal $V_{CS}$. The control circuit can regulate the average current $I_{LED}$ flowing through the plurality of LED strings 80 constantly by sensing the switching current $I_S$. In one embodiment, the sensing circuit 90 may comprise a resistor coupled between one of the terminals of the switch M1 and a logic ground GND. The voltage across the resistor is indicative of the switching current signal $I_S$ flowing through the switch M1.

In one embodiment, the estimation circuit 10 has an input terminal and an output terminal. The input terminal of the estimation circuit 10 may be coupled to the sensing circuit 90 for receiving the first current sensing signal $V_{CS}$. The estimation circuit 10 may be configured to process the first current sensing signal $V_{CS}$ and to provide a feedback signal FB at the output terminal, where the feedback signal FB is indicative of the average current signal $I_{LED}$ flowing through the plurality of LED strings 80. In one embodiment, the sensing circuit 90 and the estimation circuit 10 may be operated as an average current sensing circuit sensing an average current flowing through a plurality of LED strings.

The control circuit may further comprise an amplifying circuit 20 having a first input terminal, a second input terminal and an output terminal. The first input terminal of the amplifying circuit 20 may be coupled to the output terminal of the estimation circuit 10 for receiving the feedback signal FB. The second input terminal of the amplifying circuit 20 may be configured to receive a reference signal REF, where the reference signal REF is indicative of a desired average current flowing through the plurality of the LED strings 80. The amplifying circuit 20 may be configured to amplify the difference of the feedback signal FB and the reference signal REF, and to provide an error signal EA at the output terminal.

The control circuit may further comprise a comparing circuit 30 having a first input terminal, a second input terminal and an output terminal. The first input terminal of the comparing circuit 30 may be coupled to the output terminal of the amplifying circuit 20 for receiving the error signal EA. The second input terminal of the comparing circuit 30 may be configured to receive the first current sensing signal $V_{CS}$. The comparing circuit 30 may be configured to compare the error signal EA with the first current sensing signal $V_{CS}$, and to provide a comparing signal CA at the output terminal. In one embodiment, when the first current sensing signal $V_{CS}$ is larger than the error signal EA, the switch M1 may be turned off.

The control circuit may further comprise a zero-cross detection circuit 40 having an input terminal and an output terminal. The input terminal of the zero-cross detection circuit 40 may be coupled to the switching circuit 60 for receiving the inductor current signal $I_L$ flowing through the inductive element. The zero-cross detection circuit 40 may be configured to sense the inductor current signal $I_L$ so as to generate a second current sensing signal, and to compare the second current sensing signal with a zero-cross threshold so as to provide a zero-cross signal ZCD at the output terminal. The zero-cross signal ZCD may be configured to determine whether the inductor current signal $I_L$ achieves a zero-crossing. After turning the switch M1 off, the second current sensing signal may decrease following the decreasing of the inductor current signal $I_L$. When the second current sensing signal decreases to the zero-cross threshold, the switch M1 turns on. In one embodiment, the zero-cross threshold may comprise a zero signal. When the value of the inductor current signal $I_L$ decreases to zero, the switch M1 turns on.

In such non-isolated topology LED driving circuit, the zero-cross detection circuit 40 may comprise a fourth winding pulled from the inductor. The fourth winding may be configured to sense the inductor current signal $I_L$ flowing through the inductor and to provide the second current sensing signal. The zero-cross detection circuit 40 may further comprise a zero-cross comparing circuit having a first input terminal, a second input terminal and an output terminal. The first input terminal of the zero-cross comparing circuit is configured to receive the second current sensing signal. The second input terminal of the zero-cross comparing circuit is configured to receive the zero-cross threshold. The zero-cross comparing circuit may be configured to compare the second current sensing signal with the zero-cross threshold and to generate the zero-cross signal ZCD at the output terminal.

The control circuit may further comprise a logic circuit 50 having a first input terminal, a second input terminal and an output terminal. The first input terminal of the logic circuit 50 may be coupled to the output terminal of the comparing circuit 30 for receiving the comparing signal CA. The second input terminal of the logic circuit 50 may be coupled to the output terminal of the zero-cross detection circuit 40 for receiving the zero-cross signal ZCD. The logic circuit 50 may be configured to conduct a logical operation to the comparing signal CA and the zero-cross signal ZCD, and to provide a control signal CTRL at the output terminal. The output terminal of the logic circuit 50 may be coupled to the switching circuit 60 for providing the control signal CTRL to the switch M1, wherein the control signal CTRL is a logic high-low signal having a first logic state and a second logic state. In one embodiment, the first logic state of the control signal CTRL is logic high, and the second logic state of the control signal CTRL is logic low. In one embodiment, the first logic state of the control signal CTRL is logic low, and the second logic state of the control signal CTRL is logic high. The control signal CTRL may be configured to switch the switch M1 of the switching circuit 60 on and off so as to regulate the average current $I_{LED}$ flowing through the plurality of the LED strings 80 constantly.

Figure 4:
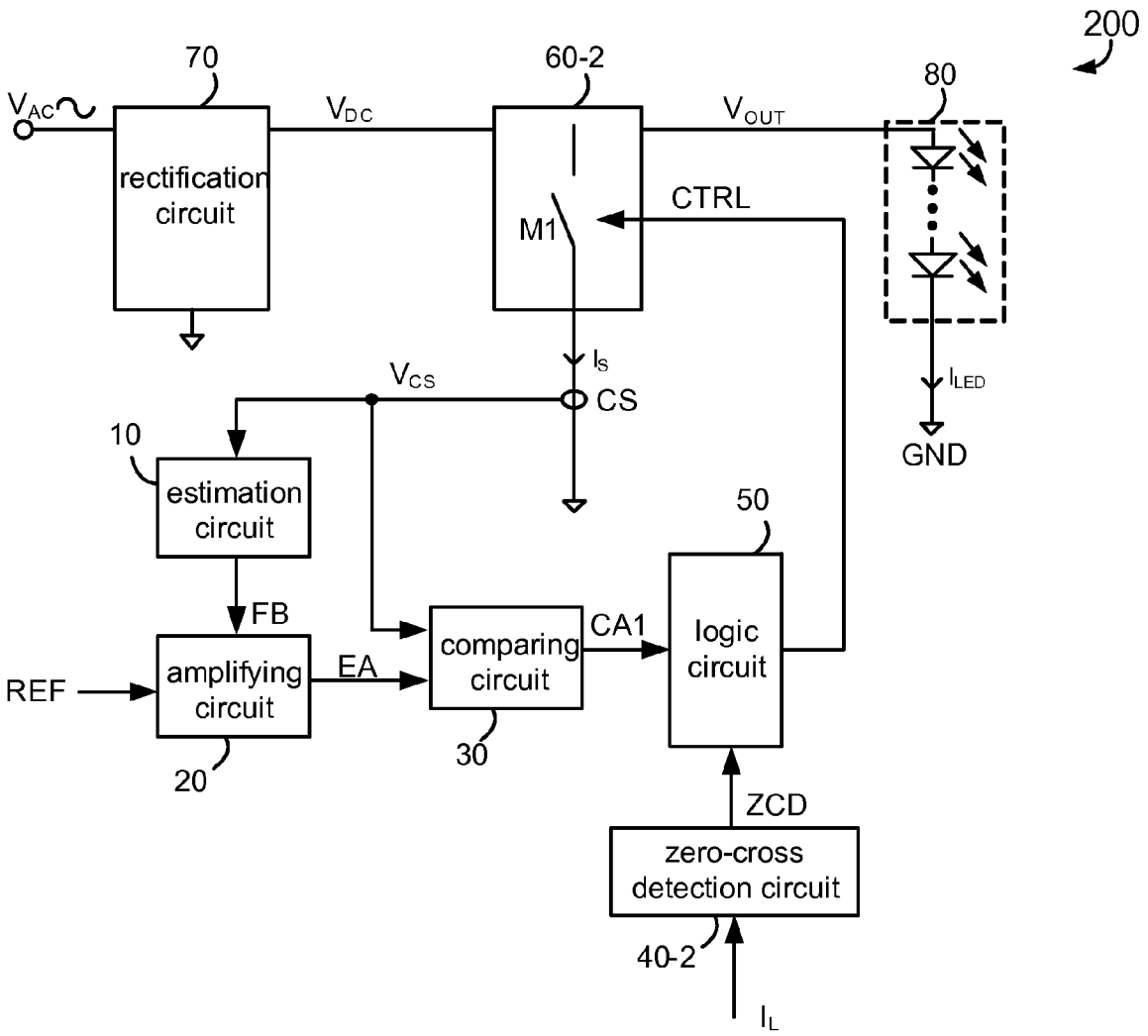
FIG. 4 illustrates a LED driving circuit according to an embodiment of the present invention.

FIG. 4 illustrates a LED driving circuit 200 according to an embodiment of the present invention. Comparing to the LED driving circuit 100, the switching circuit 60-2 may be an isolated topology switching circuit, e.g. a flyback topology, a forward topology and other suitable topology switching circuits etc. The switching circuit 60-2 may be coupled to the rectification circuit 70 for receiving the DC voltage signal $V_{DC}$ and configured to convert the DC voltage signal $V_{DC}$ to an output voltage $V_{OUT}$ for driving a plurality of LED strings 80.

In such application, the inductive element may comprise a transformer having a primary winding and a secondary winding. When the switch M1 is turned on, the transformer stores energy, and the inductor current signal $I_L$ flowing through the primary winding of the transformer may be increased linearly to a peak value. When the switch M1 is turned off, the transformer releases energy stored, and the inductor current signal $I_L$ flowing through the primary winding of the transformer may be decreased linearly from the peak value. The switch M1 may comprise any semiconductor switching devices, such as a Metal Oxide Semiconductor Field Effect Transistor (MOSFET), an Insulated Gate Bipolar Transistor (IGBT) and the like.

In the LED driving circuit 200, the zero-cross detection circuit 40-2 may comprise a third winding pulled from the transformer. The third winding may be configured to sense the inductor current signal $I_L$ flowing through the primary winding of the transformer and to provide the second current sensing signal. The zero-cross detection circuit 40-2 may further comprise a zero-cross comparing circuit having a first input terminal, a second input terminal and an output terminal. The first input terminal of the zero-cross comparing circuit is configured to receive the second current sensing signal. The second input terminal of the zero-cross comparing circuit is configured to receive a zero-cross threshold. The zero-cross comparing circuit may be configured to compare the second current sensing signal with the zero-cross threshold. Thus the zero-cross signal ZCD may be generated.

Figure 5:
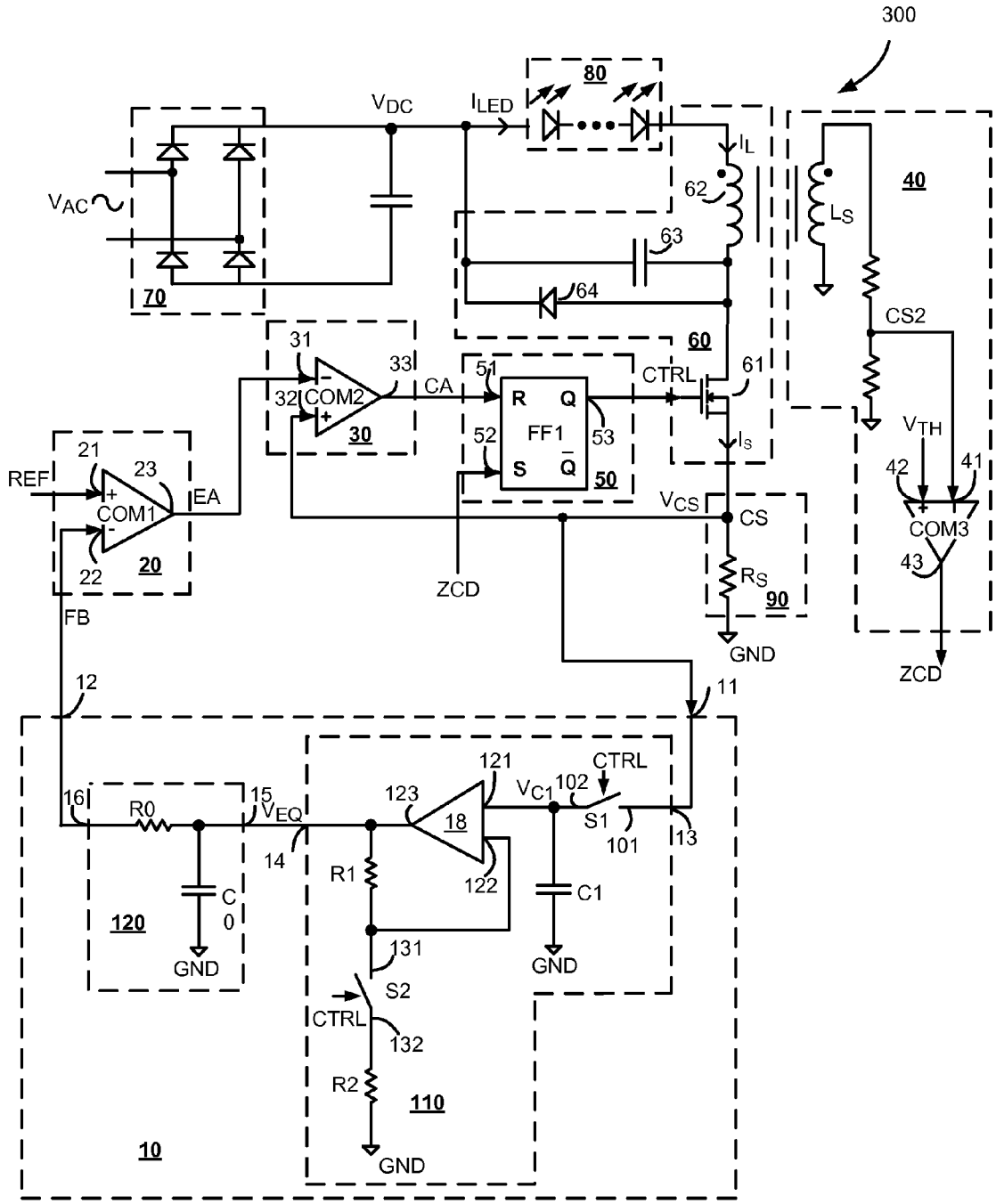
FIG. 5 schematically illustrates a LED driving circuit according to an embodiment of the present invention.

FIG. 5 schematically illustrates a LED driving circuit 300 according to an embodiment of the present invention. As shown in FIG. 5, the LED driving circuit 300 may comprise a rectification circuit 70, a switching circuit 60 and a control circuit.

In one embodiment, the rectification circuit 70 may comprise four rectifier diodes. The rectification circuit 70 may be configured to receive an AC voltage signal $V_{AC}$ at an input terminal, and to rectify the AC voltage signal $V_{AC}$ so as to provide a DC voltage signal $V_{DC}$ at an output terminal. In other embodiment, it should be understood that the number of the rectifier diodes in the rectification circuit 70 may be modified according to other design specification. For example, the rectification circuit 70 may comprise two rectifier diodes and two controlled switches.

In one embodiment, the switching circuit 60 may comprise a buck converter which is a non-isolated topology circuit. As shown in FIG. 5, the switching circuit 60 may comprise an inductor 62 having a first terminal and a second terminal, a capacitor 63 having a first terminal and a second terminal, a diode 64 having a first terminal and a second terminal and a switch 61 having a source, a drain and a gate. One terminal of the plurality of the LED strings 80 may be coupled to the output terminal of the rectification circuit 70 for receiving the DC voltage signal $V_{DC}$. The other terminal of the plurality of the LED strings 80 may be coupled to the first terminal of the inductor 62. The first terminal of the capacitor 63 may be connected to the first terminal of the diode 64 and coupled to the output terminal of the rectification circuit 70. The second terminal of the inductor 62 may be connected to the second terminal of the capacitor 63 and the second terminal of the diode 64. The drain of the switch 61 may be connected to the second terminal of the inductor 62. The source of switch 61 may be connected to the logic ground GND. The gate of the switch 61 may be coupled to the control circuit for receiving a control signal CTRL so as to turn the switch 61 on and off. The inductor 62 may be operated as an inductive element configured to convert energy. When the switch 61 is turned on, the inductor 62 may store energy, and when the switch 61 is turned off, the inductor 62 may release energy stored. It should be obvious to one of ordinary skill in the art that in other embodiment, the switching circuit 60 may comprise other suitable topology, e.g., a flyback topology converter, a forward topology converter etc.

The control circuit may comprise a sensing circuit 90, an estimation circuit 10, an amplifying circuit 20, a comparing circuit 30, a zero-cross detection circuit 40 and a logic circuit 50.

As shown in FIG. 5, the sensing circuit 90 may be illustrated as a sensing resistor $R_S$. The sensing resistor $R_S$ may be connected between the drain of the switch 61 and the logic ground GND. One terminal of the sensing resistor $R_S$ is connected to the source of the switch 61 to constitute a common node CS. The first current sensing signal $V_{CS}$ is generated at the common node CS when the switching current signal $I_S$ flows through the sensing resistor $R_S$.

In one embodiment, the estimation circuit 10 has an input terminal 11 and an output terminal 12. The input terminal of the estimation circuit 10 may be coupled to the common node CS for receiving the first current sensing signal $V_{CS}$. The estimation circuit 10 may be configured to process the first current sensing signal $V_{CS}$ and to provide a feedback signal FB at the output terminal 12, where the feedback signal FB is indicative of an average current $I_{LED}$ flowing through the plurality of LED strings 80. In one embodiment, the feedback signal FB and the average current signal $I_{LED}$ may have a linear relationship, e.g. $FB=2\times I_{LED}\times R_S$.

In one embodiment, the estimation circuit 10 may comprise a voltage converter 110 and a filter circuit 120. The voltage converter 110 may have an input terminal 13 and an output terminal 14. The input terminal 13 of the voltage converter 110 may be coupled to the output terminal 12 of the estimation circuit 10 for receiving the first current sensing signal $V_{CS}$. The voltage converter 110 may be configured to convert the first current sensing signal $V_{CS}$, and to provide an equivalent voltage signal $V_{EQ}$ at the output terminal 14 of the voltage converter 110. The filter circuit 120 may have an input terminal 15 and an output terminal 16. The input terminal 15 of the filter circuit 120 may be coupled to the output terminal 14 of the voltage converter 110. The filter circuit 120 may be configured to filter the equivalent voltage signal $V_{EQ}$, and to provide the feedback signal FB at the output terminal 16 of the filter circuit 120, i.e. the feedback signal FB is indicative of an average value of the equivalent voltage signal $V_{EQ}$. Therefore, the feedback signal FB is indicative of the average current $I_{LED}$ flowing through the plurality of the LED strings 80.

The voltage converter 110 may comprise a first switch S1, a second switch S2, a first capacitor C1, a buffer 18, a first resistor R1 and a second resistor R2.

The buffer 18 has a first input terminal 121, a second input terminal 122 and an output terminal 123. The first input terminal 121 of the buffer 18 may be coupled to the input terminal of the voltage converter 110 by the first switch S1. The second input terminal 122 of the buffer 18 may be coupled to the output terminal of the buffer 18 by the first resistor R1. The output terminal 123 operated as the output terminal 14 of the voltage converter 110 may be coupled to the input terminal 15 of the filter circuit 120. In one embodiment, the buffer 18 may comprise an operational amplifier.

The first switch S1 has a first terminal 101, a second terminal 102 and a control terminal. The first terminal 101 of the first switch S1 may be configured to operate as the input terminal 13 of the voltage converter 110 for receiving the first current sensing signal $V_{CS}$. The second terminal 102 of the first switch S1 may be coupled to the first input terminal 121 of the buffer 18. The control terminal of the first switch S1 may be coupled to the output terminal 53 of the logic circuit 50 for receiving the control signal CTRL to control the first switch S1 on and off. In other words, switching the first switch S1 on and off is synchronous with that of the switch 61. The first capacitor C1 has a first terminal, a second terminal. The first terminal of the first capacitor C1 may be coupled to the second terminal 102 of the first switch S1 and the first input terminal 121 of the buffer 18. The second terminal of the first capacitor C1 is connected to the logic ground GND. When the first switch S1 turns on, the first input terminal 121 of the buffer 18 receives the first current sensing signal $V_{CS}$. Meanwhile, the first capacitor C1 is charged to a maximal value $V_{C1}$ of the first current sensing signal $V_{CS}$. When the first switch S1 turns off, the first input terminal 121 of the buffer 18 is received the maximal value $V_{C1}$ provided by the first capacitor C1.

The second switch S2 has a first terminal 131, a second terminal 132 and a control terminal. The first terminal 131 of the second switch S2 may be coupled to the second input terminal 122 of the buffer 18. The second terminal 132 of the second switch S2 may be coupled to one terminal of the second resistor R2. The control terminal of the second switch S2 may be coupled to the output terminal of the logic circuit 50 for receiving the control signal CTRL to control the second switch S2 on and off. In other words, switching the second switch S2 on and off is synchronous with that of the switch 61. The other terminal of the second resistor R2 is connected to the logic ground GND. The first resistor R1 is coupled between the second input terminal 122 and the output terminal 123 of the buffer 18. The value of the first resistor R1 is equal to the value of the second resistor R2, i.e. R1=R2. When the second switch S2 turns on, the value of the equivalent voltage signal $V_{EQ}$ is twice of the first current sensing signal $V_{CS}$, i.e. $V_{EQ}=2V_{CS}$. When the second switch S2 turns off, the value of the equivalent voltage signal $V_{EQ}$ is equal to the maximal value $V_{C1}$ of the first current sensing signal $V_{CS}$, i.e. $V_{EQ}=V_{C1}$.

The filter circuit 120 may comprise a second capacitor C2 and a third resistor R0. The second capacitor C2 may be connected between the input terminal 15 of the filter circuit 120 and the logic ground GND. The third resistor R0 may be connected between the input terminal 15 and the output terminal 16 of the filter circuit 120. The filter circuit 120 may be configured to filter the equivalent voltage signal $V_{EQ}$ and to provide the feedback signal FB at the output terminal 16 of the filter circuit 120, i.e. the feedback signal FB is indicative of the average of the equivalent voltage signal $V_{EQ}$. In other embodiment, the filter circuit 120 may comprise other suitable structures. For example, the filter circuit 120 may comprise several resistors and capacitors. In addition, the value of the second capacitor C2 and the third resistor R0 can be regulated.

Continued to FIG. 5, the amplifying circuit 20 may comprise an amplifier COM1 having a first input terminal 21, a second input terminal 22 and an output terminal 23. The first terminal 21 of the amplifier COM1 may be configured to receive a reference signal REF, where the reference signal REF is indicative of the desired average current flowing through the plurality of the LED strings 80. The second terminal 22 of the amplifier COM1 may be coupled to the output terminal 12 of the estimation circuit 10 for receiving the feedback signal FB. The amplifier COM1 may be configured to amplify the difference of the reference signal REF and the feedback signal FB, and to provide an error signal EA at the output terminal 23.

In one embodiment, the comparing circuit 30 may comprise an comparator COM2 having a first input terminal 31, a second input terminal 32 and an output terminal 33. The first terminal 31 of the comparator COM2 may be coupled to the output terminal 23 of the amplifier COM2 for receiving the error signal EA. The second input terminal 32 of the comparator COM2 may be coupled to the node CS for receiving the first current sensing signal $V_{CS}$. The comparator COM2 may be configured to compare the error signal EA with the first current sensing signal $V_{CS}$, and to provide a comparing signal CA at the output terminal 33. In one embodiment, when the first current sensing signal $V_{CS}$ is larger than the error signal EA, the switching M1 may be turned off.

In one embodiment, the zero-cross detection circuit 40 may comprise a comparator COM3 having a first input terminal 41, a second input terminal 42 and an output terminal 43. The first input terminal 41 of the comparator COM3 may be configured to receive a second current sensing signal CS2 which is indicative of the inductor current signal $I_L$ flowing through the inductor 62 of the switching circuit 60. The second input terminal 42 of the comparator COM3 may be configured to receive a zero-cross threshold signal $V_{TH}$, e.g. zero. The comparator COM3 may be configured to compare the second current sensing signal CS2 with the zero-cross threshold signal $V_{TH}$, and to provide a zero-cross signal ZCD at the output terminal 43. The zero-cross signal ZCD may be configured to determine whether the inductor current signal $I_L$ achieves a zero-crossing. In one embodiment, when the second current sensing signal CS2 decreases to the zero-cross threshold signal $V_{TH}$, the switch 61 turns on.

The zero-cross detection circuit 40 may further comprise a winding $L_S$ pulled from the inductor 62 and a resistor divider. The winding $L_S$ may be configured to sense the inductor current signal $I_L$ of the inductor 62 and to provide the second current sensing signal CS2 by the resistor divider.

In one embodiment, the logic circuit 50 may comprise an RS latch having a first input terminal 51, a second input terminal 52 and an output terminal 53. The first input terminal 51 of the RS latch may be coupled to the output terminal 33 of the comparator COM2 for receiving the comparing signal CA. The second input terminal 52 of the RS latch may be coupled to the output terminal 43 of the comparator COM3 for receiving a zero-cross signal ZCD. The RS latch may be configured to conduct a logical operation to the comparing signal CA and the zero-cross signal ZCD, and to provide a control signal CTRL at the output terminal 53. The output terminal 53 of the logic circuit 50 may be coupled to the gate of the switch 61 for providing the control signal CTRL. The control signal CTRL is configured to regulate the average current signal $I_{LED}$ by switching the switch 61 on and off.

Figure 6:
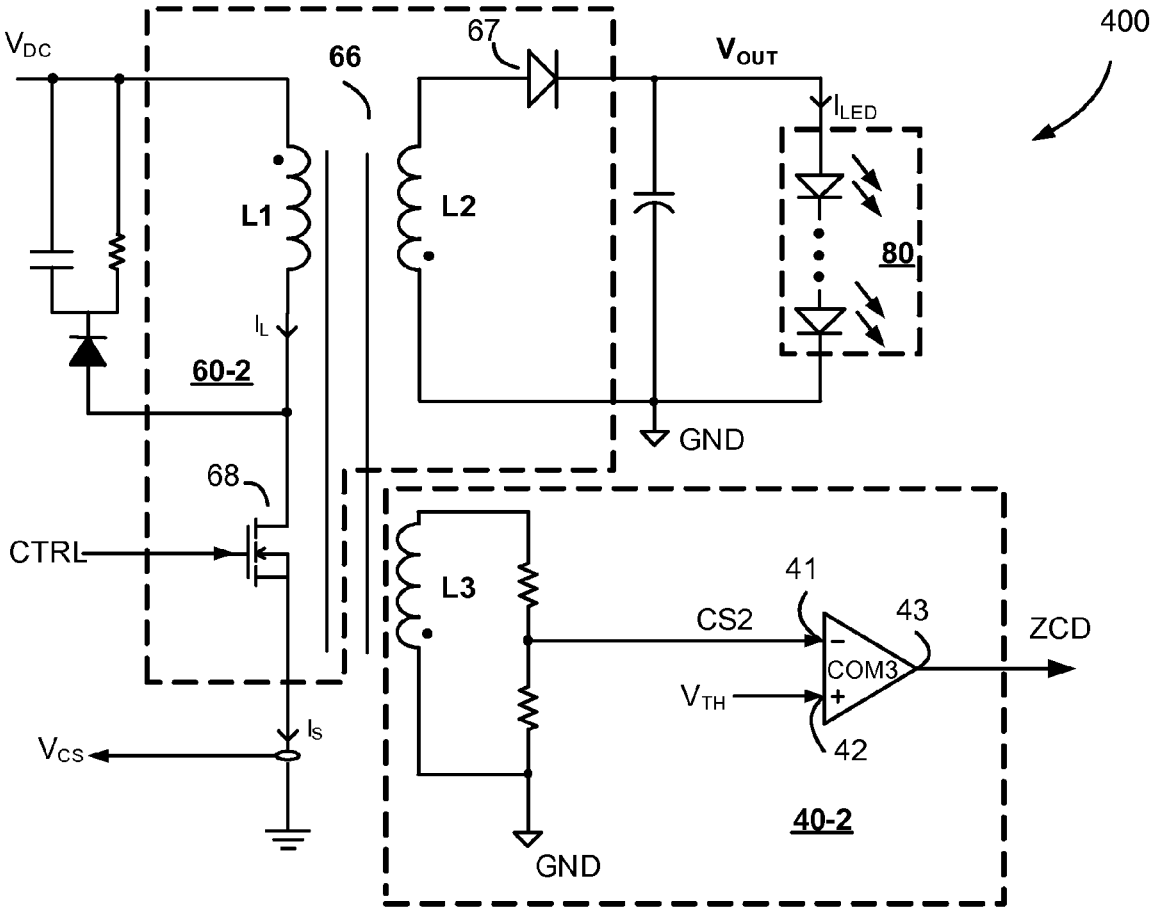
FIG. 6 schematically illustrates a LED driving circuit according to an embodiment of the present invention.

FIG. 6 schematically illustrates a LED driving circuit 400 according to an embodiment of the present invention. The switching circuit 60-2 may comprise a flyback converter which is an isolated topology circuit. the switching circuit 60-2 is configured to convert the DC voltage signal $V_{DC}$ to the output voltage signal $V_{OUT}$ for driving the plurality of LED strings 80. As shown in FIG. 6, the switching circuit 60-2 may comprise a transformer 66 having a primary winding L1 and a secondary winding L2, a diode 67 having a first terminal and a second terminal, and a switch 68 having a source, a drain and a gate. One terminal of the primary winding L1 of the transformer 66 is configured to receive the DC voltage signal $V_{DC}$. The other terminal of the primary winding L1 of transformer 66 may be connected to the drain of the switch 68. The source of switch 68 may be connected to the logic ground GND. The gate of the switch 68 may be coupled to the control circuit for receiving a control signal CTRL so as to turn the switch 68 on and off. The first terminal of the diode 67 is coupled to one terminal of the secondary winding L2 of the transformer 66, and the second terminal of the diode 67 is coupled to one terminal of the plurality of the LED strings 80. The other terminal of the secondary winding L2 of transformer 66 may be connected to the ground GND.

The transformer 66 may be operated as an inductive element configured to convert energy. When the switch 68 is turned on, the transformer 66 may store energy, and the inductor current signal $I_L$ flowing through the primary winding of the transformer may be increased linearly to a peak value. When the switch 68 is turned off, the transformer 66 may release energy stored, and the inductor current signal $I_L$ flowing through the primary winding of the transformer 66 may be decreased linearly from the peak value.

The zero-cross detection circuit 40-2 may comprise a third winding L3 pulled from the transformer 66 and a resistor divider. The third winding L3 may be configured to sense the inductor current signal $I_L$ of the transformer 66 and to provide the second current sensing signal CS2 by the resistor divider. The zero-cross detection circuit 40-2 may further comprise a comparator COM3 having a first input terminal 41, a second input terminal 42 and an output terminal 43. The first input terminal 41 of the comparator COM3 may be configured to receive the second current sensing signal CS2. The second input terminal 42 of the comparator COM3 may be configured to receive a zero-cross threshold signal $V_{TH}$, e.g. zero. The comparator COM3 may be configured to compare the second current sensing signal CS2 with the zero-cross threshold signal $V_{TH}$, and to provide a zero-cross signal ZCD at the output terminal 43.

Figure 7:
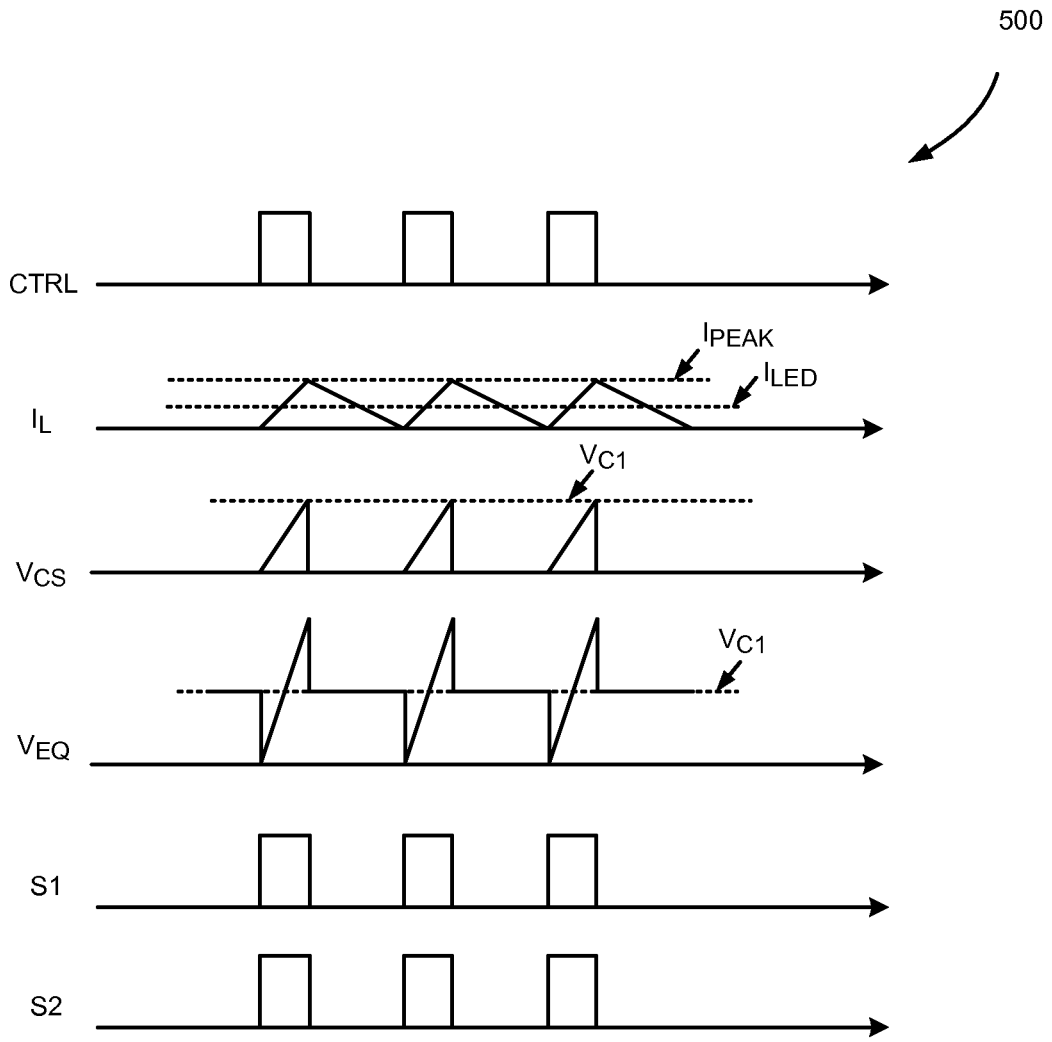
FIG. 7 illustrates a schematic waveforms diagram of various signals generated in each switching cycle of a LED driving circuit according to an embodiment of the present invention.

FIG. 7 illustrates a schematic waveforms diagram 500 of various signals generated in each switching cycle of a LED driving circuit 300 according to an embodiment of the present invention.

Referred to FIG. 5, when the control signal CTRL is logic high, the switch 61 of the switching circuit 60, the first switch S1 and the second switch S2 of the voltage converter 110 are turned on. Therefore, the first current sensing signal $V_{CS}$ may increase linearly to a maximal value $V_{C1}$ and the value of the equivalent voltage signal $V_{EQ}$ is twice of the first current sensing signal $V_{CS}$, i.e. $V_{EQ}=2V_{CS}$. Accordingly, the inductor current signal $I_L$ of the inductor 62 may increase from zero to a maximal value $I_{PEAK}$. When the control signal CTRL is logic low, the switch 61 of the switching circuit 60, the first switch S1 and the second switch S2 of the voltage converter 110 turn off. Accordingly, the first current sensing signal $V_{CS}$ equals to zero and the value of the equivalent voltage signal $V_{EQ}$ equals to the maximal value $V_{C1}$, i.e. $V_{EQ}=V_{C1}$. The inductor current signal $I_L$ of the inductor 62 may decrease from a maximal value $I_{PEAK}$ to zero. After filtering by the filter 120, the average value of the equivalent voltage signal $V_{EQ}$ equals to the maximal value $V_{C1}$, i.e. the feedback signal FB equals to the maximal value $V_{C1}$ of the first current sensing signal $V_{CS}$. Therefore, the equation is effective: $FB=V_{C1}=I_{PEAK}\times R_S=2\times I_{LED}\times R_S$.

As we known, the varying of feedback signal FB follows the reference signal FB, if we set the reference signal REF to $2\times I_{LED}\times R_S$, the average current signal $I_{LED}$ can be regulated by sensing the switching current signal $I_S$.

In one embodiment, if the output power of a LED driving circuit is greater than 25 W, a power factor correction (PFC) function may be needed in such applications. For example, in the embodiment shown in FIG. 5, if the output power of the LED driving circuit 300 is greater than 25 W, an extra multiplier may be applied. The multiplier may be configured to receive the sensing signal of the DC voltage signal $V_{DC}$ and the error signal EA, and to conduct a multiply operation to the DC voltage signal $V_{DC}$ and the error signal EA so as to generate a synchronized signal with the DC voltage signal $V_{DC}$ to the logic circuit 50. The synchronized signal may be configured to make an input current signal of the LED driving circuit following an input voltage signal of the LED driving circuit (i.e. the AC voltage signal $V_{AC}$) with a same phase, and then a PFC function may be achieved.

It should be noted that the ordinary skill in the art should know that the LED driving circuit, the control circuit and associated current sensing circuit presented in this invention not only limited in a topology, but also in other large applications needed. Similarly, the sensing circuit, controller etc. presented in this application only used to schematically show an example.

While various embodiments have been described above, it should be understood that they have been presented by way of example only, and not limitation. Thus, the breadth and scope of a presented embodiment should not be limited by any of the above-described exemplary embodiments, but should be defined only in accordance with the following claims and their equivalents.

We claim:

1. A control circuit for a LED driving circuit, wherein the LED driving circuit comprises a switching circuit comprising at least one switch and an inductive element, and wherein the switching circuit is configured to receive a DC voltage signal for driving a plurality of LED, and to receive a control signal configured to control the at least one switch to switch on and off so as to regulate an average current flowing through the plurality of LED; the control circuit comprising:

a sensing circuit coupled between the at least one switch and a logic ground, wherein the sensing circuit is configured to sense a switching current signal flowing through the at least one switch, and to provide a first sensing signal, and wherein the first sensing signal is indicative of the switching current signal;

an estimation circuit having an input terminal and an output terminal, wherein the input terminal of the estimation circuit is coupled to the sensing circuit for receiving the first sensing signal; and wherein the estimation circuit is configured to process the first sensing signal, and to provide a feedback signal at the output terminal, wherein the feedback signal is indicative of the average current signal flowing through the plurality of LED;

an amplifying circuit having a first input terminal, a second input terminal and an output terminal, wherein the first input terminal of the amplifying circuit is coupled to the output terminal of the estimation circuit for receiving the feedback signal; and wherein the second input terminal of the amplifying circuit is configured to receive a reference signal, wherein the reference signal is indicative of a desired average current of the plurality of LED; and wherein the amplifying circuit is configured to amplify the difference of the feedback signal and the reference signal, and to provide an error signal at the output terminal;

a comparing circuit having a first input terminal, a second input terminal and an output terminal, wherein the first input terminal of the comparing circuit is coupled to the output terminal of the amplifying circuit for receiving the error signal; and wherein the second input terminal of the comparing circuit is configured to receive the first sensing signal; and wherein the comparing circuit is configured to compare the error signal with the first sensing signal, and to provide a comparing signal at the output terminal; and wherein when the first sensing signal is larger than the error signal, the comparing signal is configured to turn the at least one switch off; and a zero-cross detection circuit having an input terminal and an output terminal, wherein the input terminal of the zero-cross detection circuit is coupled to the switching circuit, and configured to receive a current signal flowing through the inductive element so as to generate a second sensing signal, wherein the second sensing signal is indicative of the current signal flowing through the inductive element; and wherein the zero-cross detection circuit is configured to compare the second sensing signal with a zero-cross threshold, and to provide a zero-cross signal at the output terminal; and wherein when the second sensing signal decreases to the zero-cross threshold, the zero-cross signal is configured to turn the at least one switch on.

2. The control circuit of claim 1 further comprising:

a logic circuit having a first input terminal, a second input terminal and an output terminal; wherein the first input terminal of the logic circuit is coupled to the output terminal of the comparing circuit for receiving the comparing signal; and wherein the second input terminal of the logic circuit is coupled to the output terminal of the zero-cross detection circuit for receiving the zero-cross signal; and wherein the logic circuit is configured to conduct a logical operation to the comparing signal and the zero-cross signal; and wherein the output terminal of the logic circuit is coupled to the switching circuit for providing the control signal to the at least one switch.

3. The control circuit of claim 1, wherein the estimation circuit comprising:

a voltage converter having an input terminal and an output terminal, wherein the input terminal of the voltage converter is configured to operate as the input terminal of the estimation circuit for receiving the first sensing signal; and wherein the voltage converter is configured to convert the first sensing signal and to provide a first voltage signal at the output terminal; and a filter circuit having an input terminal and an output terminal, wherein the input terminal of the filter circuit is coupled to the output terminal of the voltage converter for receiving the first voltage signal; and wherein the output terminal of the filter circuit is configured to operate as the output terminal of the estimation circuit for providing the feedback signal.

4. The control circuit of claim 3, wherein the voltage converter comprises a buffer, a first switch, a second switch, a first capacitor, a first resistor and a second resistor, and wherein the buffer having a first input terminal, a second input terminal and an output terminal, wherein the first input terminal of the buffer is coupled to the input terminal of the voltage converter by the first switch; and wherein the second input terminal of the buffer is coupled to the output terminal of the buffer by the first resistor; and wherein the output terminal of the buffer is configured to operate as the output terminal of the voltage converter;

a first switch having a first terminal, a second terminal and a control terminal, wherein the first terminal of the first switch is configured to operate as the input terminal of the voltage converter for receiving the first sensing signal; and wherein the second terminal of the first switch is coupled to the first input terminal of the buffer; and wherein the control terminal of the first switch is coupled to the output terminal of the logic circuit for receiving the control signal, wherein the control signal is configured to switch the first switch on and off;

a second switch having a first terminal, a second terminal and a control terminal, wherein the first terminal of the second switch is coupled to the second input terminal of the buffer; and wherein the second terminal of the second switch is coupled to one terminal of the second resistor; and wherein the control terminal of the second switch is coupled to the output terminal of the logic circuit for receiving the control signal, wherein the control signal is configured to switch the second switch on and off;

the first capacitor is coupled between the second terminal of the first switch and the logic ground;

the first resistor is coupled between the second input terminal of the buffer and the output terminal of the buffer; and the second resistor is coupled between the second terminal of the second switch and the logic ground; wherein the value of the first resistor is equal to the value of the second resistor.

5. The control circuit of claim 4, wherein the buffer comprises an operational amplifier.

6. The control circuit of claim 3, wherein the filter circuit comprising:

a second capacitor is coupled between the input terminal of the filter circuit and the logic ground; and a third resistor is coupled between the input terminal of the filter circuit and the output terminal of the filter circuit.

7. The control circuit of claim 1, wherein the inductive element comprises a transformer having a primary winding and a secondary winding; and wherein the current signal flowing through the inductive element comprises an inductor current signal flowing through the primary winding of the transformer; and wherein when the at least one switch is turned on, the transformer stores energy, and when the at least one switch is turned off, the transformer releases energy stored.

8. The control circuit of claim 7, wherein the zero-cross detection circuit comprising:

a third winding pulled from the transformer, wherein the third winding is configured to sense the inductor current signal flowing through the primary winding of the transformer, and to provide the second sensing signal; and a comparing circuit having a first input terminal, a second input terminal and an output terminal, wherein the first input terminal of the comparing circuit is configured to receive the second sensing signal; and wherein the second input terminal of the comparing circuit is configured to receive a zero-cross threshold; and wherein the comparing circuit is configured to compare the second sensing signal with the zero-cross threshold, and to provide the zero-cross signal at the output terminal.

9. The control circuit of claim 1, wherein the inductive element comprises an inductor; and wherein the current signal flowing through the inductive element comprises an inductor current signal flowing through the inductor; and wherein when the at least one switch is turned on, the inductor stores energy, and when the at least one switch is turned off, the inductor releases energy stored.

10. The control circuit of claim 9, wherein the zero-cross detection circuit comprising:

a fourth winding pulled from the inductor, wherein the fourth winding is configured to sense the inductor current signal flowing through the inductor, and to provide the second sensing signal; and a comparing circuit having a first input terminal, a second input terminal and an output terminal, wherein the first input terminal of the comparing circuit is configured to receive the second sensing signal; and wherein the second input terminal of the comparing circuit is configured to receive a zero-cross threshold; and wherein the comparing circuit is configured to compare the second sensing signal with the zero-cross threshold, and to provide the zero-cross signal at the output terminal.

11. A LED driving circuit, comprising:

a rectification circuit configured to receive and rectify an AC voltage signal so as to provide a DC voltage signal;

a switching circuit comprising at least one switch and an inductive element, wherein the switching circuit is configured to receive the DC voltage signal for driving a plurality of LED, and to regulate an average current flowing through the plurality of LED by controlling the at least one switch switching on and off;

a sensing circuit coupled between the at least switch and a logic ground, wherein the sensing circuit is configured to sense a switching current flowing through the at least one switch, and to provide a first sensing signal, wherein the first sensing signal is indicative of the switching current;

an estimation circuit having an input terminal and an output terminal, wherein the input terminal of the estimation circuit is coupled to the sensing circuit for receiving the first sensing signal; and wherein the estimation circuit is configured to process the first sensing signal, and to provide a feedback signal at the output terminal, wherein the feedback signal is indicative of the average current signal flowing through the plurality of LED;

an amplifying circuit having a first input terminal, a second input terminal and an output terminal, wherein the first input terminal of the amplifying circuit is coupled to the output terminal of the estimation circuit for receiving the feedback signal; and wherein the second input terminal of the amplifying circuit is configured to receive a reference signal, wherein the reference signal is indicative of a desired average current of the plurality of LED; and wherein the amplifying circuit is configured to amplify the difference of the feedback signal and the reference signal, and to provide an error signal at the output terminal;

a comparing circuit having a first input terminal, a second input terminal and an output terminal, wherein the first input terminal of the comparing circuit is coupled to the output terminal of the amplifying circuit for receiving the error signal; and wherein the second input terminal of the comparing circuit is configured to receive the first current sensing signal; and wherein the comparing circuit is configured to compare the error signal with the first sensing signal, and to provide a comparing signal at the output terminal; and wherein when the first sensing signal is larger than the error signal, the comparing signal is configured to turn the at least one switch off; and a zero-cross detection circuit having an input terminal and an output terminal, wherein the input terminal of the zero-cross detection circuit is coupled to the switching circuit, and configured to sense a current signal flowing through the inductive element so as to generate a second sensing signal, wherein the second sensing signal is indicative of the current signal flowing through the inductive element; and wherein the zero-cross detection circuit is configured to compare the second sensing signal with a zero-cross threshold, and to provide a zero-cross signal at the output terminal; and wherein when the second sensing signal decreases to the zero-cross threshold, the zero-cross signal is configured to turn the at least one switch on.

12. An average current sensing circuit for a LED driving circuit comprising at least one switch and an inductive element, wherein an average current signal flowing through a plurality of LED is regulated by switching the at least one switch on and off; the average current sensing circuit comprising:

a sensing circuit coupled between the at least one switch and a logic ground, wherein the sensing circuit is configured to sense a switching current flowing through the at least one switch, and to provide a first sensing signal; and an estimation circuit coupled to the first sensing circuit for receiving the first sensing signal, wherein the estimation circuit is configured to convert the first sensing signal, and to provide a feedback signal at an output terminal of the estimation circuit, wherein the feedback signal is indicative of the average current flowing through the plurality of LED.

13. The average current sensing circuit of claim 12, wherein the estimation circuit comprising:

a voltage converter having an input terminal and an output terminal, wherein the input terminal of the voltage converter is configured to operate as the input terminal of the estimation circuit for receiving the first sensing signal; and wherein the voltage converter is configured to convert the first sensing signal and to provide a first voltage signal at the output terminal; and a filter circuit having an input terminal and an output terminal, wherein the input terminal of the filter circuit is coupled to the output terminal of the voltage converter for receiving the first voltage signal; and wherein the output terminal of the filter circuit is configured to operate as the output terminal of the estimation circuit for providing the feedback signal.

14. The average current sensing circuit of claim 13, wherein the voltage converter comprises a buffer, a first switch, a second switch, a first capacitor, a first resistor and a second resistor, and wherein the buffer having a first input terminal, a second input terminal and an output terminal, wherein the first input terminal of the buffer is coupled to the input terminal of the voltage converter by the first switch; and wherein the second input terminal of the buffer is coupled to the output terminal of the buffer by the first resistor; and wherein the output terminal is configured to operate as the output terminal of the voltage converter;

the first switch having a first terminal, a second terminal and a control terminal, wherein the first terminal of the first switch is configured to operate as the input terminal of the voltage converter for receiving the first sensing signal; and wherein the second terminal of the first switch is coupled to the first input terminal of the buffer; and wherein the control terminal of the first switch is coupled to the output terminal of the logic circuit for receiving the control signal, wherein the control signal is configured to switch the first switch on and off;

the second switch having a first terminal, a second terminal and a control terminal, wherein the first terminal of the second switch is coupled to the second input terminal of the buffer; and wherein the second terminal of the second switch is coupled to one terminal of the second resistor; and wherein the control terminal of the second switch is coupled to the output terminal of the logic circuit for receiving the control signal, wherein the control signal is configured to switch the second switch on and off;

the first capacitor is coupled between the second terminal of the first switch and the logic ground;

the first resistor is coupled between the second input terminal of the buffer and the output terminal of the buffer; and the second resistor is coupled between the second terminal of the second switch and the logic ground; and wherein the value of the first resistor is equal to the value of the second resistor.

15. The average current sensing circuit of claim 13, wherein the filter circuit further comprising:

a second capacitor is coupled between the input terminal of the filter circuit and the logic ground; and a third resistor is coupled between the input terminal of the filter circuit and the output terminal of the filter circuit.

16. The average current sensing circuit of claim 12, wherein the sensing circuit comprises a sensing resistor, wherein the voltage across the sensing resistor is the first sensing signal.

* * * * *